United States Patent [19]

Simo et al.

[11] 4,244,345

[45] Jan. 13, 1981

[54] ARCHERY BOW WITH FORCE BALANCING TORSION ELEMENT

[75] Inventors: Miroslav A. Simo, Riverside; Josef Tosovsky, Berwyn, both of Ill.

[73] Assignee: New Archery Products Corp., Riverside, Ill.

[21] Appl. No.: 944,744

[22] Filed: Sep. 22, 1978

[51] Int. Cl.[3] ..... F41B 5/00

[52] U.S. Cl. ..... 124/24 R; 124/16

[58] Field of Search ..... 124/23 R, 24 R, 86, 124/88, 1, 80, 25, 4, 5, 16

[56] References Cited

U.S. PATENT DOCUMENTS 306,234 10/1884 Fox ..... 124/24 R 3,981,290 9/1976 Islas ..... 124/24 R 4,041,927 8/1977 Van House ..... 124/16

*Primary Examiner*—Richard C. Pinkham

*Assistant Examiner*—William R. Browne

*Attorney, Agent, or Firm*—Thomas W. Speckman

[57] ABSTRACT

An archery bow with a cam surface in fixed and force transmitting relation to each opposing limb and a torsion device extending between the cam surfaces, a cam following device on each end of the torsion means in force transmitting relation to the cam surfaces on the opposing limbs. A torsion rod and torsion tube and combinations of these may be used to both multiply the draw force transmitted to the arrow and to provide synchronization of the opposing bow limbs.

24 Claims, 16 Drawing Figures

ARCHERY BOW WITH FORCE BALANCING TORSION ELEMENT

This invention relates to an archery bow with a force balancing torsion means which also contributes to the stored potential energy in the bow and changes the force/draw curve from steadily increasing to one that is first increasing and then decreasing. More particularly, the archery bow of this invention has a rigid central handle portion with an outwardly extending resilient limb attached to each opposite end region of the handle portion, a bow string attached to the outboard region of each limb, and a drawing force control and equalizer torsion means having a cam following means at each end in force transmitting relation to a cam surface in fixed and force transmitting relation to each of the opposing limbs. The draw pull relation to the draw length is controlled by the contour of the cam surface and the draw pull force controlled by resistance of the torsion element. The torsion element provides an automatic force balancing mechanism between the opposing limbs and eliminates the need for any other synchronization mechanism.

There have been a number of proposed archery bows which multiply the draw force transmitted to the arrow. U.S. Pat. No. 3,674,001 teaches auxiliary limbs and U.S. Pat. No. 3,486,495 teaches a complicated variable leverage pulley system through which the bow string is strung to multiply the draw force as it is applied to the arrow. One disadvantage of the bows as taught by these patents is that there is no provision for the balancing of uneven forces between the limbs and thus requires that the bow be equipped with a separate synchronization mechanism and that the bow be drawn without variation in finger pressure on the string or hand pressure on the handle in order to assure that uneven and inconsistent force factors are not applied to the arrow upon release. Further, energy is lost in the pulley-bow string system due to friction resulting in a large hysterises loop between drawing and releasing of the arrow. The desirability of providing a draw force multiplying bow with synchronized movement of the opposing limb members which will create a balance between the opposing limbs in order to avoid the application of undesired force factors to the arrow when shot from the bow, is recognized by the teachings of U.S. Pat. No. 3,981,290. The bow taught by the U.S. Pat. No. 3,981,290 provides a complicated pulley-cable system to synchronize the movement of the two limb members and a separate cam and cam follower system for each limb which requires coordinated adjustment of the cams for each limb. The bow taught by U.S. Pat. No. 4,078,537 has rigid links to the end of each limb which act to synchronize or balance the movement of the opposing limbs. These methods of limb synchronization greatly increase friction which results in loss of kinetic energy imparted to the arrow.

It is an object of this invention to overcome many of the disadvantages of the prior art compound bows.

It is an object of this invention to provide a bow having both multiplied draw force transmitted to the arrow and simplified synchronization of the opposing limbs of the bow.

It is yet another object of this invention to provide a bow wherein synchronization of the opposing limbs is provided by a torsion element, the opposing ends of which are in contact with a cam surface in force transmitting relation to each of the limbs.

It is another object of this invention to provide a bow wherein the torsion draw pull multiplying and opposing limb synchronization means may be fully enclosed within the central handle portion.

It is still another object of this invention to provide a bow wherein the draw pull and force characteristics imparted to the arrow are controlled by a replaceable cam surface and a single torsion element adjustment while maintaining synchronization of the opposing bow limbs.

It is yet another object of this invention to provide a bow having a torsion means providing synchronization of opposing limbs utilizing a torsion rod and a torsion tube providing adjustment of draw pull of the bow with a single adjustment.

These and other objects, advantages, and features of this invention will be apparent from the description and by reference to the drawings wherein preferred embodiments are shown as:

Figure 1:
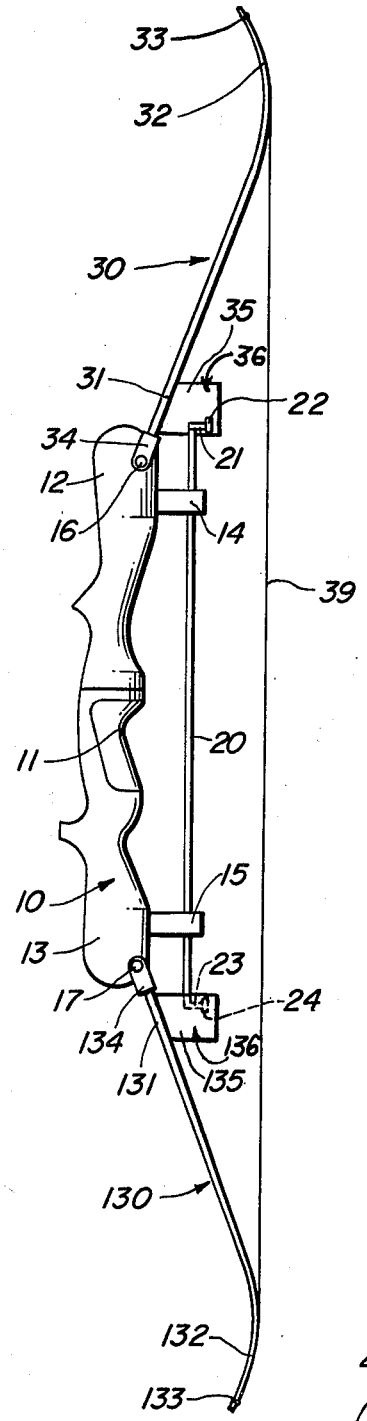
FIG. 1 is the side view of one embodiment of a bow of this invention in the undrawn position.
Figure 2:
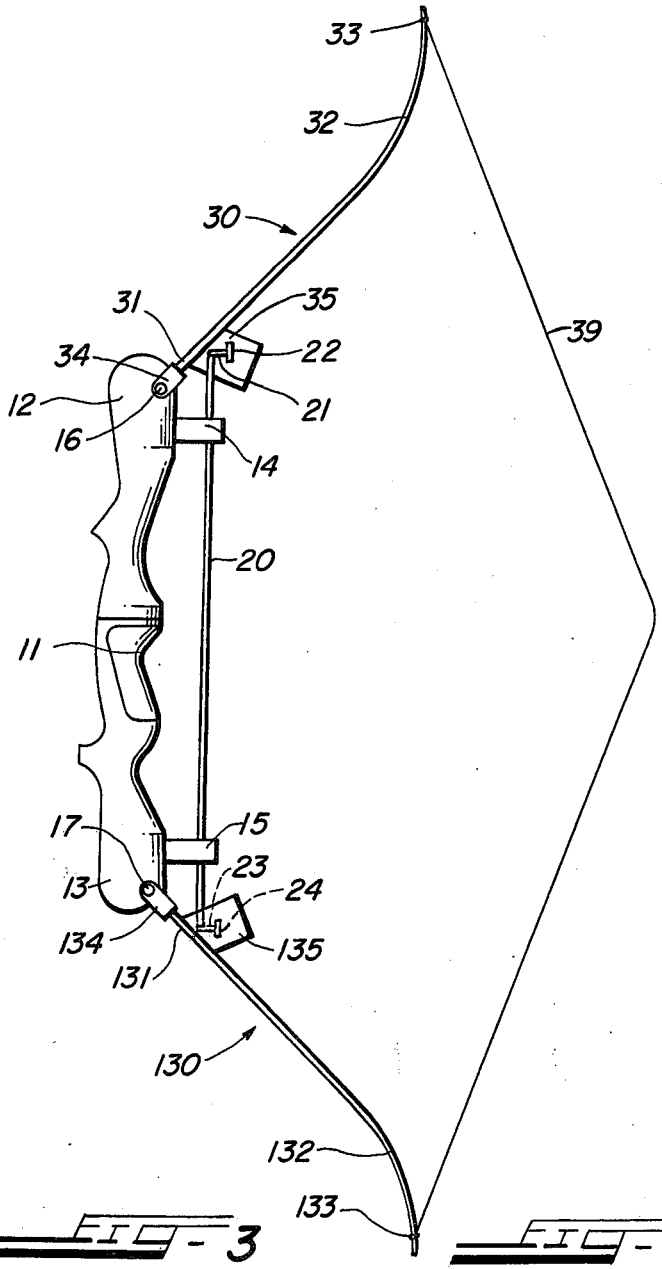
FIG. 2 is a side view of the bow shown in FIG. 1 in the fully drawn position.

The bow shown in FIG. 1 in the undrawn position and in FIG. 2 in the drawn position has central handle portion 10 and opposing upper limb 30 and lower limb 130 joined at their outboard portions 32 and 132, respectively, by bow string 39. Central handle portion 10 has handle 11 in its midportion and upper end region 12 and opposing lower end region 13. Upper limb 30 has an inboard region 31 and outboard region 32 with bow string notch 33. The corresponding portions of lower limb 130 are designated by similar numbers in the 100 series. Each of the opposing outwardly extending resilient limbs is pivotally attached to each opposite end region of the central handle portion. Any suitable pivot attachment means may be used. While a pivot attachment is shown in the drawings, the limbs may be rigidly fixed to the handle portion and flexing of the limb provide the entire limb movement. As shown in FIGS. 1 and 2, the inboard region 31 of upper limb 30 has upper limb pivot saddle 34 with upper pivot pin 16 extending through both sides of the U-shaped pivot saddle and the upper end region 12 of bow central portion 10. Likewise, lower limb 130 may be attached to lower end region 13 of bow central portion 10 by lower limb pivot saddle 134 and lower pivot pin 17. Cam plate 35 has cam surface 36 on the side facing the viewer and is in force transmitting relation to upper limb 30. Lower limb cam plate 135 has cam surface 136 on the side away from the viewer and is in force transmitting relation to lower limb 130.

Figure 7:
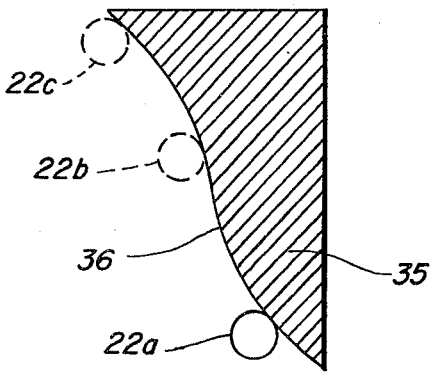
FIG. 7 is a cross-sectional view of a cam surface along the path of the cam following means according to one embodiment of this invention.
Figure 9:
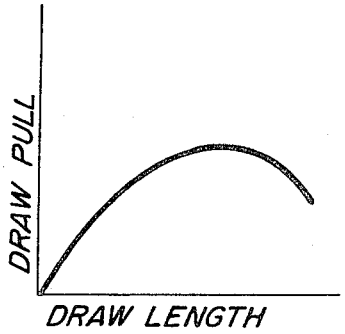
FIG. 9 shows a typical draw pull force versus draw length curve for a bow of this invention.

The torsion element shown in FIGS. 1 and 2 is torsion rod 20 extending through upper torsion means bearing 14 and lower torsion means bearing 15 and having upper cam arm 21 with upper cam follower 22 in contact with cam surface 36. The lower end of torsion rod 20 has lower cam arm 23 and lower cam follower 24 in contact with cam surface 136. As shown in FIGS. 1 and 2 cam plates 35 and 135 are rigidly attached to the inboard regions 31 and 131 of upper limb 30 and lower limb 130, respectively. The cam plates have surfaces as shown in FIG. 7 showing the cross-sectional view of a cam surface along the path of the cam follower means. In FIG. 7, 36 is the cam surface along which cam follower 22 travels. Cam follower 22 is in position **22*a* as shown in FIG. 7, when the bow as shown in FIG. 1 is in the undrawn position and during drawing moves along the cam surface 36 to position 22*c* as shown in FIG. 7 when the bow is in the fully drawn position as shown in FIG. 2. A cam surface as shown in FIG. 7 results in the desired draw pull force versus draw length curve as shown in FIG. 9. As seen in FIG. 9, the draw pull reaches a maximum prior to the full draw length and then the draw pull force reduces as the bow is drawn to the full extent. The maximum draw pull force as shown in FIG. 9 corresponds to cam follower position 22*b* shown in FIG. 7. The cam surfaces may be of different shapes to produce desired draw pull force-draw length characteristics. For example, the entire cam plate may be replaced or the cam plate may have accommodation for attachment of various desired cam surfaces. Variances of the cam surfaces and means for replacement and attachment of the cam surfaces should be readily apparent to one skilled in the art, as long as the cam surfaces are maintained in force transmitting relation to the bow limb. The cam surfaces of the embodiment shown in FIGS. 1 and 2** are on opposite sides of the cam plates and the lower cam surface is upside down with respect to the upper cam surface so that both upper and lower cam followers are traversing the same portion of the identical upper and lower cam surfaces.

As shown in FIG. 1 and in FIG. 7 in the undrawn position both cam followers are at corresponding extreme positions of the cam surfaces. As the bow string is drawn to the fully drawn position shown in FIG. 2, the cam followers traverse the cam surfaces to the opposite extreme positions. Traversal of the cam surfaces causes an opposite rotational force to be imparted to each end of torsion rod 20. The torsion rod cam arms 21 and 23, dependent upon their length, intensify the force transmitted to and from torsion rod 20. When the bow string is released to propel the arrow, the energy from flexing of the limbs and the torque energy stored in the torsion means acts to provide amplified and equalized force to the arrow. The torsion means serves to synchronize both the force and the movement of each of the opposing limbs. The synchronization is the result of opposite rotational forces being transmitted at opposite ends of a unified torsion means.

Figure 8:
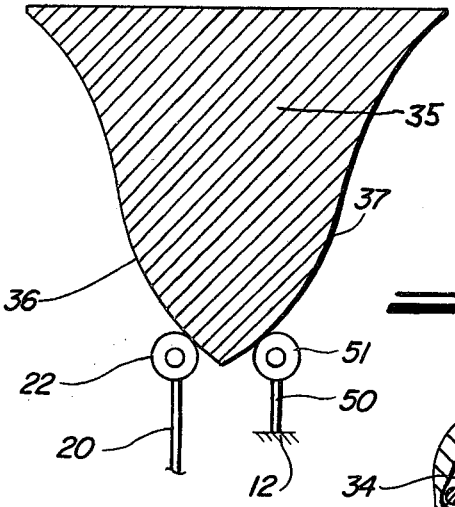
FIG. 8 is a cross-sectional view of a cam surface of another embodiment of this invention showing a counter torsion element to reduce limb torque.

The embodiment of this invention as shown in FIGS. 1 and 2 does apply a torque to the bow limbs which may cause undesired friction in the pivoting of the limbs with respect to the bow central handle portion. This may be readily overcome by imparting an opposite rotational force to the limb by providing a counter torsion means 50 as shown in FIG. 8 having counter torsion cam follower 51 traveling along counter cam surface 37 which is a mirror image of cam surface 36. The counter torsion means is fixed at the end opposite cam follower means 51 to upper end region 12 or upper torsion means bearing bracket 14 to supply the desired counter torsion to torsion plate 35. Similar counter torsion means may be applied at both upper and lower cam plates to equalize the torsion imparted in each of the limbs by torsion means shown in FIGS. 1 and 2 as torsion rod 20.

Figure 3:
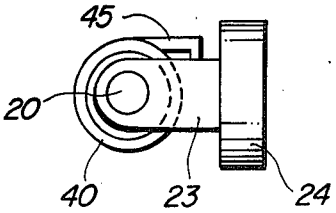
FIG. 3 is a bottom view of the end of a torsion means with a cam following means according to one embodiment of this invention having a torsion rod and an adjustable torsion tube.
Figure 4:
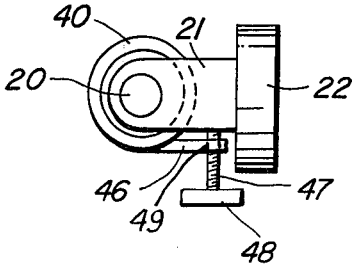
FIG. 4 is the top view of the opposite end of the torsion means shown in FIG. 3.

The torsion means may utilize multiple torsion elements to advantage in the bow of this invention. One embodiment of torsion means utilizing multiple torsion elements is shown in FIGS. 3 and 4. FIG. 3 is the bottom view and FIG. 4 is the top view of opposite ends of torsion means embodying both a torsion rod and a torsion tube. FIG. 3 shows torsion rod 20 affixed to lower cam arm 23 having lower cam follower 24. FIG. 4 shows the upper end of torsion rod 20 having affixed upper cam arm 21 and cam follower 22. Torsion tube 40 is fitted loosely concentrically to torsion rod 20 and has lower stop arm abutting the side of lower cam arm 23 as seen in FIG. 3. As seen in FIG. 4, the upper end of torsion tube 40 has upper stop arm 46 provided with threaded hole 49 in a position such that torsion adjustment screw 47 may be screwed into threaded hole 49, the end of the screw abutting torsion rod upper cam arm 21. The torsion adjustment screw is provided with a convenient head 48 for hand adjustment. Thus, it is seen that energy may be stored in torsion tube 40 by advancing torsion adjustment screw 47. The storage of energy in torsion tube 40 results in upward displacement of draw pull force-draw length curve characteristics as shown in FIG. 9. This provides a bow with a single easy adjustment of the draw pull force while automatically maintaining the synchronization of the opposing bow limbs.

Figure 5:
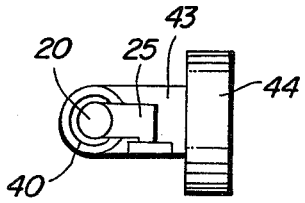
FIG. 5 is a bottom view of the lower end of a torsion means according to another embodiment of this invention having an adjustable torsion rod and a torsion tube.
Figure 6:
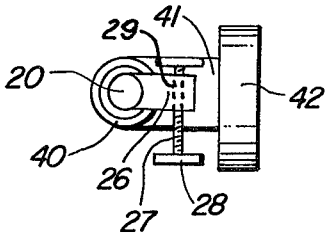
FIG. 6 is a top view of the opposite end of the torsion means shown in FIG. 5.

The same single adjustment of draw pull force of the bow while maintaining synchronization between the opposing limbs of the bow may also be obtained in the manner shown in FIGS. 5 and 6. FIG. 5 is a bottom view showing torsion tube 40 rigidly attached to torsion tube lower cam arm 43 and torsion tube lower cam follower 44 while FIG. 6 is a top view showing the upper end of torsion tube 40 to be rigidly attached to torsion tube upper cam arm 41 having torsion tube upper cam follower 42. Torsion rod 20 is loosely fitted within torsion tube 40 and at the bottom has torsion rod lower stop arm rigidly affixed and abutting a stop plate fixed to torsion tube lower cam arm 43. At the upper end torsion rod 20 has torsion rod upper stop arm 26 rigidly affixed with threaded hole 29 and torsion rod adjustment screw 27 threadedly engaged therein in abutting a stop plate fixed to torsion tube upper cam arm 41. Torsion rod torsion adjustment screw 27 has an enlarged head 28 for easy hand-adjustment. It is seen that both embodiments shown in FIGS. 3–4 and 5–6 function in the same manner, the torsion tube being adjustable in the first instance and the torsion rod being adjustable in the second instance.

The torsion means may be any suitable elongated structure which stores rotational forces applied to the opposite ends. For example, suitable torsion elements include rods, tubes and spirals. The torsion elements may be made of any suitable material known to the art for storage of rotational energy and sized to provide the storage of desired energy for the application described herein. The size, material and types of multiple torsion units are readily known to one skilled in the art. Likewise, it is readily seen that torsion elements may be used singly or combined in multiples to provide torsion means for use in the bow of this invention. The specific shapes and dimensions of the cam surface suitable to produce desired draw pull force characteristics will be apparent to one skilled in the art. The shapes of the cam surfaces are not shown in the complete drawings, but all the cams shown have suitably shaped surfaces. The desired length of the cam arms to amplify the force is readily apparent to one skilled in the art.

Cam following means suitable for use in this invention may be of any suitable low friction cam following devices known to the art such as rotating wheels, rotating spheres within sockets and the like. The nature of the most satisfactory cam following means depends upon the physical arrangement of the cam surface and the cam following means. The cam following means may be located at the outward region of the cam follower arm.

Figure 10:
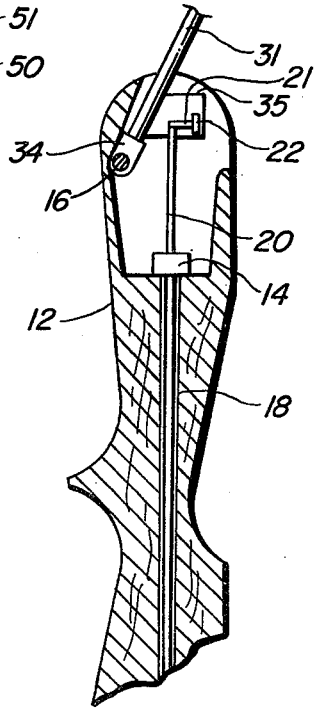
FIG. 10 is a cross-sectional view of one end of the central handle portion of one embodiment of a bow of this invention having the torsion element within the central handle portion.

The torsion means may be enclosed within the central handle portion 10 as shown by the cross-sectional view of the upper end region 12 in FIG. 10. As seen in FIG. 10, upper pivot pin 16 about which upper limb 30 pivots is within a cavity in upper end region 12. As shown in FIG. 10, the bow is in the corresponding position to that of the bow in FIG. 1 and torsion rod 20 extends through center section cavity 18 to lower end region 13 where lower limb 130 is pivoted in the same fashion.

It is apparent that cam plates 35 and 135 may be attached to the limbs in the inboard regions, the distance from the pivotal attachment of the limb to the central handle portion 10 providing an effective lever arm. The cam plates may also be attached to the limb in the region of the pivotal attachment itself, such as attached directly to the pivot saddles or they may be attached to the opposite side of the pivot from the bow limb. An embodiment of the attachment of the cam plates to the opposite side of the limbs from the pivot is shown in FIGS. 11–15. As seen in FIGS. 1 and 2, the cam plates may be attached at about right angles to the plane of the limbs and as seen in FIGS. 11–15, the cam plates may be attached in about the same plane as the plane of the limbs or slightly varied therefrom to obtain more efficient use of the space available.

Figure 11:
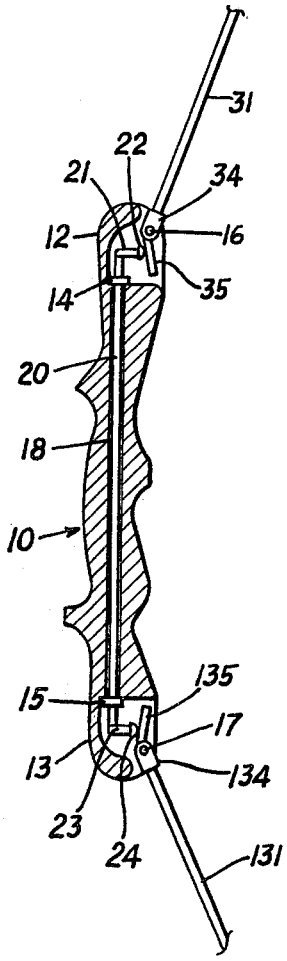
FIG. 11 is a cross-sectional side view of a portion of a bow of another embodiment of this invention in the undrawn position and having the torsion element within the central handle portion.
Figure 12:
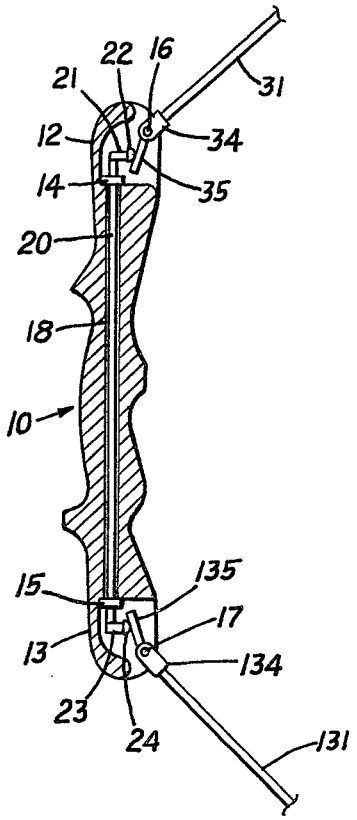
FIG. 12 is a cross-sectional side view of the drawn position of the bow shown in FIG. 11.
Figure 13:
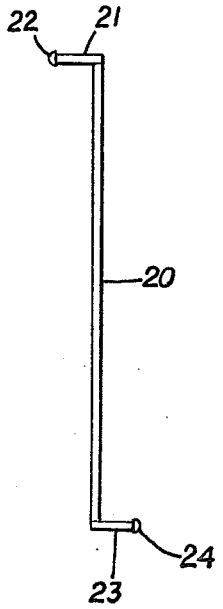
FIG. 13 is a front view of the torsion element of the bow as shown in FIG. 12.
Figure 14:
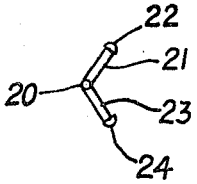
FIG. 14 is a top view of the torsion element of the bow as shown in FIG. 11.
Figure 15:
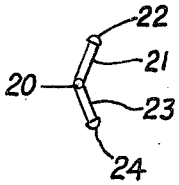
FIG. 15 is a top view of the torsion element of the bow as shown in FIG. 12.

FIG. 11 shows the bow in the undrawn position with the cam followers 22 and 24 in one extreme position of the cam surface on cam plates 35 and 135, respectively, while FIG. 12 shows the cam followers at the opposite extreme position when the bow is fully drawn. It is noted that in this embodiment, the torsion means cam arms 21 and 23 extend from opposite sides of torsion rod 20 as shown in FIGS. 13–15, while in the embodiment shown in FIGS. 1 and 2, the cam arms extend from the same side of the torsion rod.

Figure 16:
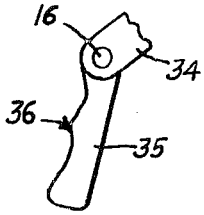
FIG. 16 is an enlarged side view of one embodiment of a cam surface suitable for embodiments shown in FIGS. 11 and 12.

FIG. 16 shows an enlarged view of the shape of cam surface 36 as used in the embodiment shown in FIGS. 11 and 12.

It is thus seen that a wide variety of physical configurations of torsion means and shapes and physical locations of cam surfaces may be used in the practice of the invention disclosed. The specific torsion elements and cam surfaces are shown for illustrative purposes without limiting the invention in any way. The essential elements of the archery bow disclosed herein are a rigid central handle portion with an outwardly extending resilient limb attached to each opposite end region of the handle portion, a bowstring attached to the outboard region of each limb, and a torsion means having a cam following means at each end in force transmitting relation to a cam surface, each cam surface in force transmitting relation to each of said limbs. Modifications and additions to each of these elements are readily apparent to one skilled in the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In an archery bow of the type comprising a rigid central handle portion with a first outwardly extending resilient opposing limb at one end and a second outwardly extending resilient opposing limb at the opposite end and having a bow string attached to the outboard region of each limb, the improvement comprising: an elongated torsion means extending between said limbs; a first cam following means at one end of said torsion means and a second cam following means at a second opposite end of said torsion means, said first cam following means in force transmitting contact against a first cam surface in fixed and force transmitting relation to said first outwardly extending limb and said second cam following means in force transmitting contact against a second cam surface in fixed and force transmitting relation to said second limb, whereby a force applied by said first cam surface is transmitted through said first cam following means in contact therewith to said torsion means and through said torsion means to said second cam following means at the opposite end thereof to said second cam surface thereby synchronizing force and movement of said first and second opposing limbs.

2. The archery bow of claim 1 wherein said torsion means comprises a torsion rod having a cam follower arm attached to each end of said torsion rod and extending therefrom at an angle to the center line of the torsion rod with one of said cam following means at the outward end region of each of said arms.

3. The archery bow of claim 1 wherein said torsion means comprises a torsion tube having a cam follower arm attached to each end of said torsion tube and extending therefrom at an angle to the center line of the torsion tube with one of said cam following means at the outward end region of each of said arms.

4. The archery bow of claim 1 wherein said torsion means comprises two torsion elements, the first of said torsion elements having a first cam following means at one end and a second cam following means at a second opposite end, the second of said torsion elements immovable with respect to rotation at one end and adjustable with respect to rotation at the other end, rotation of said adjustable end imparting torque energy to said second torsion element, one end of said second torsion element in torque force transmitting contact with one end of said first torsion element.

5. The archery bow of claim 4 wherein said first torsion element is a rod and said second torsion element is a tube.

6. The archery bow of claim 4 wherein said first torsion element is a tube and said second torsion element is a rod.

7. The archery bow of claim 1 wherein said opposing limbs are pivotally attached to said central handle portion.

8. The archery bow of claim 7 wherein each of said cam surfaces is attached to each limb in a plane about parallel to the common plane of the limbs, handle and bowstring.

9. The archery bow of claim 8 additionally having in association with each limb a counter torsion means immovable with respect to rotation at one end to said central handle portion and having a cam following means at the other end in force transmitting contact against a counter cam surface in fixed and force transmitting relation to one of said opposing limbs, said counter cam surface in opposing force relation to said cam surface of the same limb functioning so that said counter torsion means equalizes torsion imparted to said limb by said torsion means.

10. The archery bow of claim 7 wherein said pivotal attachment comprises a pivot pin about which each of said limbs pivot and each of said cam surfaces is attached to the opposite side of said pivot pin from said limb.

11. The archery bow of claim 10 wherein said torsion means is within said central handle portion.

12. The archery bow of claim 1 wherein said torsion means is within said central handle portion.

13. An archery bow comprising; a rigid central handle portion, an outwardly extending resilient limb pivotally attached to each opposite end region of said handle portion, a bowstring attached to the outboard region of each limb, and an elongated torsion means extending between said limbs; a first cam following means at one end of said torsion means and a second cam following means at a second opposite end of said torsion means, said first cam following means in force transmitting contact against a first cam surface in fixed and force transmitting relation to said first outwardly extending limb and said second cam following means in force transmitting contact against a second cam surface in fixed and force transmitting relation to said second limb, whereby a force applied by said first cam surface is transmitted through said first cam following means in contact therewith to said torsion means and through said torsion means to said second cam following means at the opposite end thereof to said second cam surface thereby synchronizing force and movement of said first and second opposing limbs.

14. The archery bow of claim 13 wherein said torsion means comprises a torsion rod having a cam follower arm attached to each end of said torsion rod and extending therefrom at an angle to the center line of the torsion rod with one of said cam following means at the outward end region of each of said arms.

15. The archery bow of claim 13 wherein said torsion means comprises a torsion tube having a cam follower arm attached to each end of said torsion tube and extending therefrom at an angle to the center line of the torsion tube with one of said cam following means at the outward end region of each of said arms.

16. The archery bow of claim 13 wherein said torsion means comprises two torsion elements, the first of said torsion elements having a first cam following means at one end and a second cam following means at a second opposite end, the second of said torsion elements immovable with respect to rotation at one end and adjustable with respect to rotation at the other end, rotation of said adjustable end imparting torque energy to said second torsion element, one end of said second torsion element in torque force transmitting contact with one end of said first torsion element.

17. The archery bow of claim 16 wherein said first torsion element is a rod and said second torsion element is a tube.

18. The archery bow of claim 16 wherein said first torsion element is a tube and said second torsion element is a rod.

19. The archery bow of claim 13 wherein said opposing limbs are pivotally attached to said central handle portion.

20. The archery bow of claim 19 wherein each of said cam surfaces is attached to each limb in a plane about parallel to the common plane of the limbs, handle and bowstring.

21. The archery bow of claim 20 additionally having in association with each limb a counter torsion means immovable with respect to rotation at one end to said central handle portion and having a cam following means at the other end in force transmitting contact against a counter cam surface in fixed and force transmitting relation to one of said opposing limbs, said counter cam surface in opposing force relation to said cam surface of the same limb functioning so that said counter torsion means equalizes torsion imparted to said limb by said torsion means.

22. The archery bow of claim 19 wherein said pivotal attachment comprises a pivot pin about which each of said limbs pivot and each of said cam surfaces is attached to the opposite side of said pivot pin from said limb.

23. The archery bow of claim 22 wherein said torsion means is within said central handle portion.

24. The archery bow of claim 13 wherein said torsion means is within said central handle portion.

* * * * *